US005296326A

United States Patent [19]

Taya et al.

[11] Patent Number: 5,296,326

[45] Date of Patent: Mar. 22, 1994

[54] MAGNETIC TONER

[75] Inventors: Masaaki Taya, Kawasaki; Hirohide Tanikawa; Yasutaka Akashi, both of Yokohama; Makoto Unno, Tokyo; Masaki Uchiyama, Ichikawa; Kiichiro Sakashita, Inagi, all of Japan

[73] Assignee: Canon Kabushiki Kaisha, Tokyo, Japan

[21] Appl. No.: 994,473

[22] Filed: Dec. 21, 1992

Related U.S. Application Data

[63] Continuation of Ser. No. 675,337, Mar. 26, 1991, abandoned.

[30] Foreign Application Priority Data

Mar. 29, 1990 [JP] Japan ..... 2-078999
Mar. 11, 1991 [JP] Japan ..... 3-070480

[51] Int. Cl.[5] ..... G03G 9/083

[52] U.S. Cl. ..... 430/106.6; 430/109; 430/110; 430/111

[58] Field of Search ..... 430/903, 106, 110, 109, 430/111, 106.6

[56] References Cited

U.S. PATENT DOCUMENTS 2,221,776 11/1940 Carlson ..... 95/5
2,618,552 11/1952 Wise ..... 95/1.9
2,874,063 2/1959 Greig ..... 117/17.5
3,909,258 9/1975 Kotz ..... 96/1 R
4,395,476 7/1983 Kanbe et al. ..... 430/102
4,448,870 5/1984 Imai et al. ..... 430/107
4,495,268 1/1985 Miyakawa ..... 430/122
4,820,603 4/1989 Sakashita ..... 430/106.6
4,946,755 8/1990 Inoue ..... 430/106.6

FOREIGN PATENT DOCUMENTS 53-035697 4/1978 Japan .
58-002226 1/1983 Japan .

*Primary Examiner*—Marion E. McCamish
*Assistant Examiner*—Rosemary Ashton
*Attorney, Agent, or Firm*—Fitzpatrick, Cella, Harper & Scinto

[57] ABSTRACT

A magnetic toner for electrophotography having stable triboelectric chargeability under various environmental conditions may be provided by using magnetic iron oxide particles having a moderately high surface Feo content, specified by the following conditions: (a) a dissolved Fe (II) content in dissolved total iron of 14–33.3 wt. % at a dissolved total iron percentage of 5±1 wt. %, (b) a dissolved Fe (II) content in dissolved total iron of 17–33.3 wt. % at a dissolved total iron percentage of 10±1 wt. %, and (c) a dissolved Fe (II) content in dissolved total iron of 18–33.3 wt. % at a dissolved total iron percentage of 15±1 wt.

52 Claims, 3 Drawing Sheets

MAGNETIC TONER

This application is a continuation of application Ser. No. 07/675,337 filed Mar. 26, 1991, now abandoned.

FIELD OF THE INVENTION AND RELATED ART

The present invention relates to a magnetic toner for use in image forming methods, such as electrophotography, electrostatic recording, and magnetic recording.

Various developing methods for visualizing electrostatic latent images with toner have been known. For example, there have been known the magnetic brush method as disclosed in U.S. Pat. No. 2,874,063; the cascade developing method as disclosed in U.S. Pat. No. 2,618,552; the powder cloud method as disclosed in U.S. Pat. No. 2,221,776; in addition, the fur brush developing method; and the liquid developing method. Among these developing methods, those developing methods using a developer composed mainly of a toner and a carrier such as the magnetic brush method, the cascade process and the liquid developing method have been widely used commercially. While these methods provide good images relatively stably, they involve common problems accompanying the use of two-component developers, such as deterioration of carriers and change in mixing ratio of the toner and carrier.

In order to obviate such problems, various developing methods using a one-component developer consisting only of a toner, have been proposed. Among these, there are many excellent developing methods, using developers comprising magnetic toner particles.

U.S. Pat. No. 3,909,258 has proposed a developing method using an electroconductive magnetic toner, wherein an electroconductive magnetic toner is carried on a cylindrical electroconductive sleeve provided with a magnet inside thereof and is caused to contact an electrostatic image to effect development. In this method, as the development zone, an electroconductive path is formed with toner particles between the recording member surface and the sleeve surface and the toner particles are attached to image portions due to a Coulomb's force exerted from the image portions to effect development. This method using an electroconductive magnetic toner is an excellent method which has obviated the problems involved in the two-component developing methods. However, as the toner is electroconductive, there is involved a problem, that it is difficult to transfer the developed image electrostatically from the recording member to a final support member such as plain paper.

As a developing method using a magnetic toner with a high resistivity which can be electrostatically transferred, a developing method using a dielectric polarization of toner particles is known. Such a method, however, involves essential problems that the developing speed is slow and a sufficient density of developed image cannot be obtained.

As another method using a high resistivity magnetic toner, there are known methods wherein toner particles are triboelectrically charged through friction between toner particles or friction between a friction member such as a sleeve and toner particles, and then caused to contact an electrostatic image-bearing member to effect development. However, these methods involve problems that the triboelectric charge is liable to be insufficient because the reduced amount of friction between the toner particles and the friction member, and the charged toner particles are liable to agglomerate on the sleeve because of an enhanced Coulomb's force.

A developing method having eliminated the above described problems has been proposed in U.S. Pat. No. 4,395,476 (corresponding to Japanese Laid-Open Patent Application (KOKAI) No. 18656/1980). In this method (so-called "jumping developing method"), a magnetic toner is applied in a very small thickness on a sleeve, triboelectrically charged and is brought to an electrostatic image to effect development. More specifically, in this method, an excellent image is obtained through such factors that a sufficient triboelectric charge can be obtained because a magnetic toner is applied onto a sleeve in a very small thickness to increase the opportunity of contact between the sleeve and the toner; the toner is carried by a magnetic force, and the magnet and the toner are relatively moved to disintegrate the agglomerate of the toner and cause sufficient friction between the toner and the sleeve; and the toner layer is caused to face an electrostatic image under a magnetic field and without contact to effect development.

In the jumping developing method known heretofore as described above, some difficulties can be encountered in some cases on continuation of repetitive copying, such as a decrease in uniformity of a developer layer carried on a developer-carrying member, occurrence of streak coating irregularities in a circumferential direction of the developer-carrying member and remarkable local thickening of the carried developer layer compared with that at the initial stage, resulting in spots irregularities or wave-like irregularities. The former results in white streaks and the latter results in spots or wave-like density irregularities respectively in developed images. These difficulties seldom occur in ordinary repetitive copying but can occur in some cases during continuous use for a long period in an extremely low temperature-low humidity environment. In such cases, a lowering in image density is liable to occur. Also in a high temperature-high humidity environment, the developer layer thickness is liable to be thinner, to result in a decrease in image density in some cases.

According to our study, it has been found that the above difficulties are caused by changes in attachment of developer powder onto the sleeve and transfer of developer powder from the sleeve.

More specifically, the above difficulties are caused by a change in environmental conditions resulting in portions of non-uniform triboelectric charge in the developer layer carried on the developer-carrying member. Thus, under extremely low temperature-low humidity conditions, a portion of the developer can have an extremely large triboelectric charge due to friction between the developer-carrying member surface and the developer and, due to an image force caused by the charge, such a portion having an extremely large triboelectric charge is liable to be accumulated in the vicinity of the developer-carrying member. The accumulated portion having an extremely large triboelectric charge affects the uniformity of coating or developing performance of the developer forming an upper layer, thus resulting in the above-mentioned difficulties such as white streaks, spot irregularities and wave-like coating irregularities.

The decrease in developer layer thickness under high temperature-high humidity conditions is caused by a non-uniformity of triboelectrification between the developer and the developer-carrying member and thus instability of triboelectric charge of the developer in the vicinity of the developer-carrying member surface.

Non-uniformity of triboelectric charge of the developer leads to ground fog as a serious image defect. In recent years, a variety of functions are required of a copying machine including superposing multi-color copying where a part of an image is erased by exposure, etc., followed by insertion of another image thereat, and framing where a marginal portion of transfer paper is erased into white. In such cases, occurrence of ground fog at parts of images to be erased in white causes a serious problem.

More specifically, when a potential of a polarity opposite to that of a latent image potential is provided by irradiation with intense light from an LED or a fuse lamp to erase an image, an increased tendency of ground fog at such parts is observed. Further, in case of multi-color superposition copying, mixing of colors can occur to impair the clarity of images.

SUMMARY OF THE INVENTION

An object of the present invention is to provide a magnetic toner causing little change in image density under varying environmental conditions.

Another object of the present invention is to provide a magnetic toner with suppressed tendency of so-called charge-up phenomenon, i.e., failure in maintenance of a suitable charge level due to accumulation of excessive charge on toner particles resulting in a decrease in image density.

Still another object of the present invention is to provide a magnetic toner giving clear images having a high image density and free from or with suppressed fog.

According to the present invention, there is provided a magnetic toner comprising magnetic toner particles containing at least a binder resin and magnetic iron oxide particles, wherein said magnetic iron oxide particles satisfy the following conditions (a)–(c):

(a) a dissolved FE(II) content in dissolved total iron of 14–33.3 wt. % at a dissolved total iron percentage of 5±1 wt.

(b) a dissolved FE(II) content in dissolved total iron of 17–33.3 wt. % at a dissolved total iron percentage of 10±1 wt. %, and (c) a dissolved FE(II) content in dissolved total iron of 18–33.3 wt. % at a dissolved total iron percentage of 15±1 wt. %.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
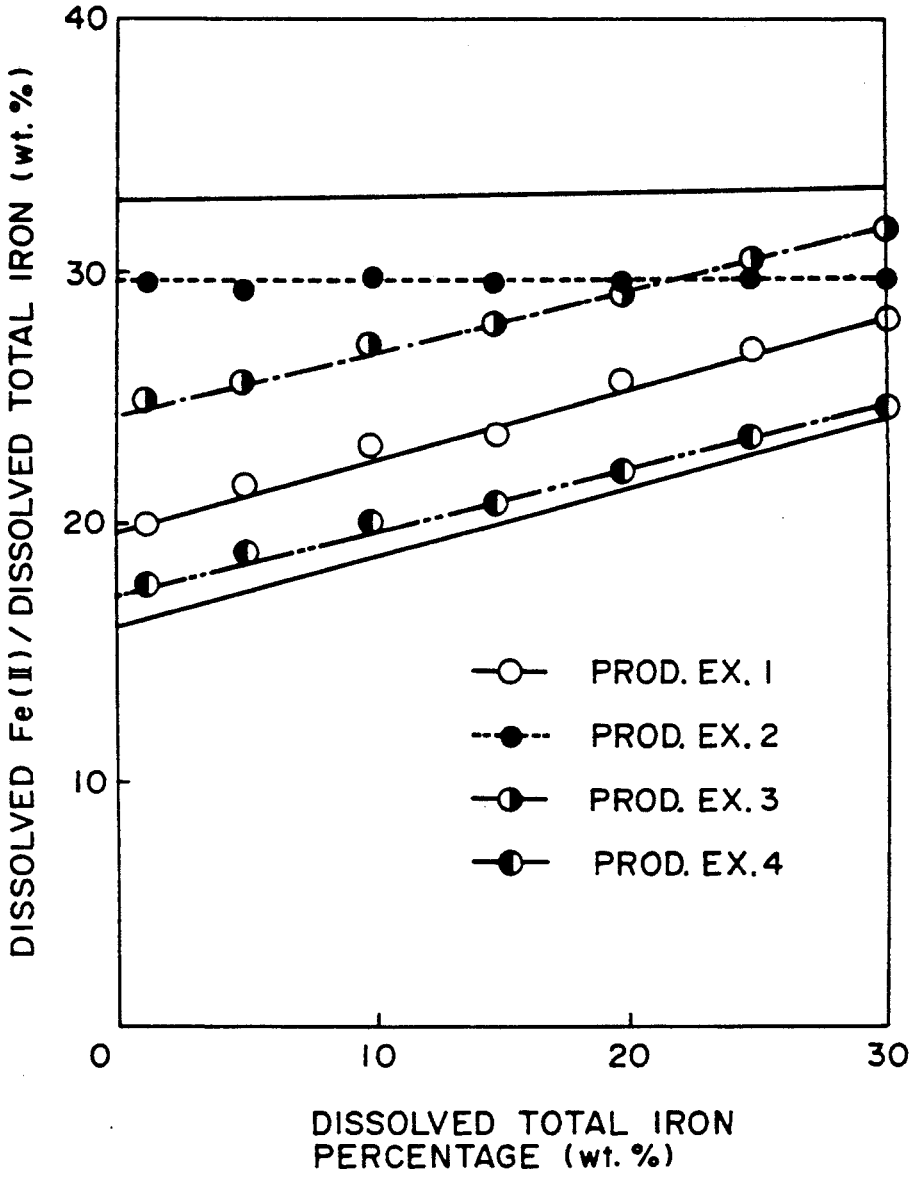
FIG. 1 is a graph showing a change in ratio of (dissolved Fe(II)/dissolved total iron) versus dissolved total iron percentage (wt. %) of magnetic iron oxides according to Production Examples 1, 2, 3 and 4.
Figure 2:
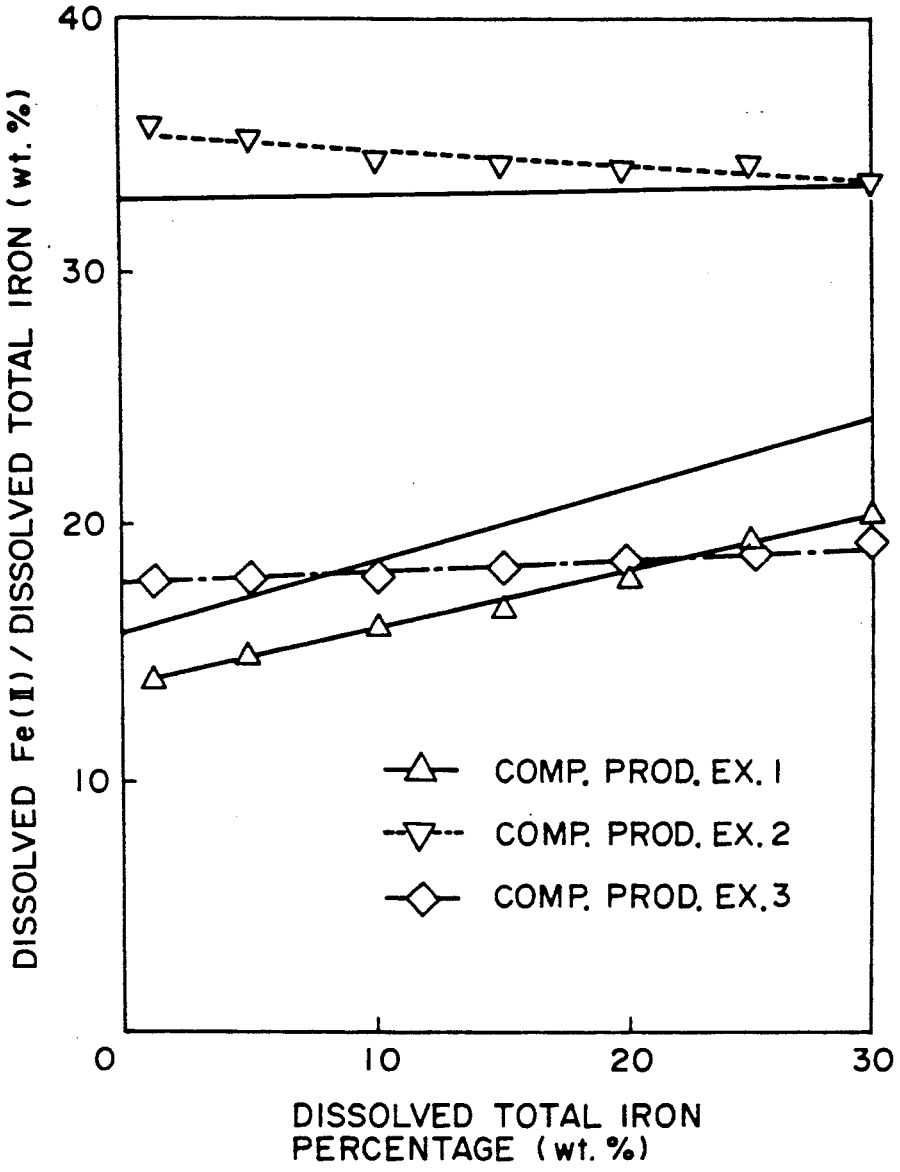
FIG. 2 is a graph showing a change in ratio of (dissolved Fe(II)/dissolved total iron) versus dissolved total iron percentage (wt. %) of magnetic iron oxides according to Comparative Production Examples 1, 2 and 3.

As a result of our study for solving the above-mentioned problems, it has been found that a principal cause of those problems resides in a magnetic material in the magnetic toner and a further study is made on magnetic materials capable of solving the problems.

As a result, we have developed a magnetic material which can be uniformly dispersed in a toner, can provide a toner with a stably and moderately controlled charge at the time of toner charging and is stable under various environmental conditions. The objects of the present invention has been accomplished by a toner using the magnetic material.

As for production of magnetic iron oxide through an aqueous solution reaction, various proposals have been made regarding kinds of alkaline materials used for neutralization or pH value of the solution containing ferrous iron oxide after the neutralization. However, the thus obtained magnetic iron oxide particles still involve some room for improvement regarding stability under various environmental conditions.

In order to improve magnetic iron oxide, it has been proposed to include an additive, such as silicic acid, aluminum or phosphoric acid, in addition to the components of inverse spinel ferrite represented by divalent metals (e.g., JP-A 58-2226). The addition of silicic acid has effective for providing an improved heat-resistance by coverage of particles surfaces (e.g., JA-A 53-35697). If this is applied to a magnetic toner, the silicic component such as silicate or silicic acid hydrate tends to remarkably impair the moisture resistance.

JP-A 58-189646 discloses a magnetic toner containing a magnetic iron oxide of which the FeO content is specified. As a result of our further study, it is true that a toner using a magnetic iron oxide having an FeO content in the range of 16–25 wt. % has a tendency of causing a smaller change in triboelectric charge under various environmental conditions, but still involves some room for improvement. The JP-A reference discloses a Comparative Example using a magnetic iron oxide containing 26 wt. % or more of FeO. The magnetic iron oxide has a small FeO content in the surface layer but has a remarkably high FeO content at the inner portion, and the magnetic iron oxide as a whole has a large FeO content. A toner containing the magnetic iron oxide actually causes a remarkable change in triboelectric charge as described in the JP-A reference.

We have now found that the distribution state of FE(II) (i.e., $Fe^{2+}$, ferrous iron) in the surface layer of magnetic iron oxide rather the FeO content in magnetic iron oxide critically contributes to stabilization of triboelectric charge of a toner under various environmental conditions.

This has not been theoretically fully clarified but it is assumed that an appropriate distribution of FE(II) in the surface layer of magnetic iron oxide affects the triboelectric charging performance controlled by a delicate balance between accumulation of triboelectric charge and relaxation of charge unique to FeO or FE(II) at microscopic interfaces during repetitive friction of toner particles.

The magnetic iron oxide used in the magnetic toner according to the present invention will now be described in more detail. The magnetic iron oxide used in the present invention is required to satisfy the following conditions (a), (b) and (c) with respect to the FE(II) content/dissolved total iron versus the dissolved total iron percentage when dissolved in aqueous sulfuric acid solution.

(a) a dissolved FE(II) content/dissolved total iron is 14–33.3 wt. % when the dissolved total iron percentage is 5±1 wt.

(b) a dissolved FE(II) content/dissolved total iron is 17–33.3 wt. % when the dissolved total iron percentage is 10±1 wt.

(d) a dissolved FE(II) content/dissolved total iron is 18–33.3 wt. % when the dissolved total iron percentage is 15±1 wt.

The magnetic iron oxide may preferably satisfy the following conditions (d), (e) and (f) with respect to the Fe(II)/content/dissolved total iron versus the dissolved total iron percentage when dissolved in aqueous sulfuric acid solution.

(d) a dissolved FE(II) content/dissolved total iron is 14–30 wt. % when the dissolved total iron percentage is 5±1 wt.

(e) a dissolved FE(II) content/dissolved total iron is 17–32 wt. % when the dissolved total iron percentage is 10±1 wt.

(f) a dissolved FE(II) content/dissolved total iron is 19–33 wt. % when the dissolved total iron percentage is 15±1 wt.

For magnetic iron oxide particles, it is possible to analyze the extreme circumferential or surface layer state of the particles in terms of a dissolved total iron (or iron element) percentage of up to.,30 wt. %. It has been found that a moderately uniform presence of $Fe^{2+}$ (i.e., Fe(II)) at the very surface layer which may be dissolved up to a dissolved total iron percentage of 16 wt. %, allows relaxation of excessive charge on the magnetic toner particles containing such magnetic iron oxide particles. Such charge relaxation effect and charge stability cannot be attained unless all the above-mentioned conditions (a)–(c) are satisfied, thus failing to provide good triboelectrification performance under various environmental conditions. More specifically, if the dissolved FE(II) content exceeds the upper limit of any one of the ranges (a), (b) and (c), the charge stability of the resultant toner is impaired under a high humidity condition. On the other hand, if the dissolved FE(II) content is lower than the lower limit of any of the ranges (a)–(c), the charge relaxation effect is lost particularly under low temperature-low humidity conditions.

The magnetic iron oxide used in the present invention may further preferably have an FeO (ferrous oxide) content per total Fe (wt. %) of 30–40 wt. It is further preferred that the magnetic iron oxide particles have a dissolved FE(II) content in total iron y (wt. %) satisfying the following conditions (g) and (h) for the range of the dissolved total iron percentage x (wt. %) satisfying $4 \leqq x \leqq 16$, particularly $0 < x \leqq 30$.

(g) $y \leqq 33.3$, and (h) $y \geqq 0.26x + 16.0$.

The limiting conditions $y = 33.3$ and $y = 0.26x + 16.0$ are indicated as the uppermost line and the lowermost line in FIG. 1 together with experimental data which will be discussed hereinafter.

By satisfying the above conditions (g) and (h) in combination, better charge stability and charge relaxation effect can be attained, whereby stable triboelectrification is accomplished under various environmental conditions.

If it is assumed that a magnetic iron oxide particle has the shape of a sphere having a particle size of 0.2 micron, a dissolved total iron percentage of 30 wt. % corresponds to dissolution of a surface layer up to about 100 Å from the surface, and a dissolved iron percentage of 16 wt. % corresponds to an about 50 Å from the surface.

The magnetic iron oxide particles used in the present invention may preferably have an apparent bulk density of 0.1–1.2 g/cc. If the magnetic iron oxide have an apparent bulk density in this range, the magnetic iron oxide particles show little agglomeratability and predominantly comprise octahedral particles rich in dispersibility, so that the effects of the present invention are enhanced. The magnetic iron oxide particles used in the present invention are also rich in affinity with a resin or an organic solvent.

The magnetic iron oxide particles may preferably have an average particle size which is larger than 0.05 micron and smaller than 0.35 micron, more preferably larger than 0.10 micron and smaller than 0.28 micron. If the particles have an average particle size of 0.05 micron or smaller, they are liable to cause agglomeration and have a lower environmental stability. If the average particle size is 0.35 micron or larger, the magnetic iron oxide particles are liable to form excessive surface projection or localize when used by dispersion in thin film or minute particles. Further, the large particles tend to cause a decrease in blackness as a hue.

Methods for measurement of the above-mentioned parameters and other physical property data will now be described in detail.

The FeO or FE(II) content (with reference to the total iron element) and the dissolved total iron percentage (iron element dissolution rate) may be measured as follows. For example, about 3 liter of deionized water is placed in a 5 liter-beaker and warmed to 45°–50° C. on a water bath. A slurry of about 25 g of magnetic iron oxide in about 400 ml of deionized water is further washed with separately provided about 805 ml of deionized water, and the resultant slurry together with the deionized water is added to the 5 liter-beaker.

Then, while the liquid in the 5 liter-beaker is maintained at about 50° C. and stirred at about 200 rpm, about 695 ml of reagent-grade sulfuric acid is added to the 5 liter beaker to start the dissolution. At this time, the magnetic iron oxide concentration is about 5 g/l and the sulfuric acid concentration is at a normality of about 5. A volume of 20 ml each of the liquid is sampled at an interval of 10 min. from the commencement of the dissolution of the magnetic iron oxide until the liquid becomes transparent due to complete dissolution, and each sample liquid is filtered through a 0.1 micron-membrane filter to recover a filtrate.

10 ml of the thus recovered sample filtrate is subjected to a quantitative analysis of iron element (total iron) by inductively coupled plasma (ICP) emission spectrometry. The dissolved total iron percentage is calculated by the following equation: Dissolved total iron percentage (%)=(Concentration of iron element in a sample (mg/l)/(concentration of iron element at complete dissolution)×100.

For measurement of the FE(II) content in each sample, about 100 ml of deionized water is added to the remaining 10 ml of the sample filtrate to form a sample solution, which is then titrated with 0.1N-$KMnO_4$ by judging coloration into slight purple as the end point. In parallel therewith, a blank titration is effected. The FE(II) concentration (mg/1) is calculated as follows.

FE(II) concentration (mg/1)=(atomic weight of Fe(II): 55.85)×(equivalent: 5)×1/10×[titration volume (ml)−blank titration volume (ml))×100.

The dissolved FE(II) content, more specifically the dissolved Fe(II)/dissolved iron element (total iron) ratio, referred to herein is basically a differential value at a specified dissolved iron element (total iron) percentage but is approximated by a value for an increment between successively taken samples. For example, the dissolved Fe(II) $content_{(10)}$ (wt. %) at the total dissolved iron percentage of 10 wt. % may be approximately obtained by the following equation by using the measured values of the dissolved total iron concentration and the dissolved FE(II) concentration for successive samples (assumed to have dissolved total iron percentages of 5 wt. % and 10 wt. %, respectively):

Dissolved FE(II) $content_{(10)}=(Fe(II)_{10}Fe(II)_5]/-[TI_{10}-TI_5)\times 100$, wherein $Fe(II)_5$ and $Fe(II)_{10}$ denote the measured values of the dissolved FE(II) concentration (mg/l) at the dissolved total iron percentage of 5 wt. % and 10 wt. %, respectively, and $TI_5$ and $TI_{10}$ denote the measured values of the dissolved total iron concentration (mg/l) according to the ICP emission spectrometry at the dissolved iron percentages of 5 wt. % and 10 wt. %, respectively.

In the present invention, the above-mentioned dissolved FE(II) content is defined at the dissolved total iron percentages of 5 wt. %, 10 wt. % and 15 wt. %, respectively as the objective values with a tolerance of ±1 wt. % each but may be similarly obtained at higher dissolved total iron percentages.

For the measurement of FeO content per total iron (FeO/Fe) (wt. %), 1 g of magnetic iron oxide is placed in a 500 ml-beaker, and 50 ml of deionized water and then 20 ml of reagent-grade sulfuric acid are added thereto to completely dissolve the magnetic iron oxide.

Then, 100 ml of deionized water and further 10 ml of aqueous $MnSO_4$ solution comprising $MnSO_4$, $H_2SO_4$ and $H_3PO_4$ (in molar ratios of 0.3:2.0:2.0) are added to the above solution to form a sample solution, which is titrated with a 0.1N $KMnO_4$ solution.

The FeO/Fe (wt. %) is calculated as follows:

FeO/Fe (wt. %)=(molecular weight of FeO: 71.85)×(equivalent: 5)×1/10 x (titration volume (ml)−blank titration volume (ml))/(dissolved total iron amount per 1 g of sample magnetic iron oxide based on the measurement according to the ICP emission spectrometry).

The apparent bulk density of magnetic iron oxide may be measured as follows. A powder tester (available from Hosokawa Micron K.K.) provided with a 710 micron-sieve is used for measurement of the apparent bulk density. Disintegrated magnetic iron oxide is placed little by little on the sieve under vibration at a stroke of about 1 mm. The placement of the magnetic iron oxide on the sieve and the vibration of the sieve are continued until an accessory cup is filled with a heap of the magnetic iron oxide. After the termination, an excessive heap of the magnetic iron oxide powder on the cup is removed by leveling with an accessory blade, and the cup containing the magnetic iron oxide is weighed. The cup has an inner volume of 100 cc, and the weight of the magnetic iron oxide is obtained by subtracting the weight of the cup per se. The apparent bulk density is calculated by the following equation:

| | |
|---|---|
| Apparent bulk density (g/cc) = | magnetic iron oxide weight (g)/100 (cc) |

The measurement of average particle size and observation of shape of magnetic iron oxide may be performed as follows. Sample magnetic iron oxide is held on a copper-meshed collodion fi.1m and photographed through a transmission microscope ("H-700H", available from Hitachi Seisakusho K.K.) at a magnification of $10^4$ under an acceleration voltage of 100 KV, followed by printing at an enlargement ratio of 3 times to obtain a photograph at an overall magnification of $3\times 10^4$. The photograph is used for observation of the shape of the sample magnetic iron oxide particles, and the average particle size is obtained by measuring and averaging the largest lengths of the respective photographed particles.

The magnetic iron oxide used in the magnetic toner according to the present invention may be prepared in the following manner.

For example, ferrous sulfate ($FESO_4$) is neutralized in an aqueous NAOH solution to form $Fe(OH)_2$ and then the liquid is brought to pH 12–13 by addition of an NAOH aqueous solution, followed by oxidation with steam and air to form a slurry of magnetite.

Then, the magnetite may be recovered from the slurry and dried by means of a warm gas drier, e.g., at 50°–140° C. in air or in an inert gas such as nitrogen to form magnetite particles. The drying may be performed under a reduced pressure as desired. The resultant magnetic iron oxide may be further reduced in a hydrogen atmosphere to adjust the FeO content in the resultant magnetic iron oxide and/or treated by a disintegrator, such as a fret mill, to provide an appropriate bulk density. The above-mentioned drying step may preferably be conducted in an inert gas atmosphere since the drying in air tends to cause surface oxidation of the magnetic iron oxide to-reduce the FE(II) content in the surface layer.

Alternatively, the slurry of magnetite as obtained may be treated by an attritor in the presence of a dispersant as desired to a solid content on the order of 40 wt. % and then dried by a spray drier of, e.g., a disk atomizer type.

In order to produce the magnetic toner according to the present invention, the magnetic iron oxide may be used in an amount of 40–150 wt. parts, preferably 50–120 wt. parts, per 100 wt. parts of the binder resin.

The binder for use in constituting the toner according to the present invention, when applied to a hot pressure roller fixing apparatus using an oil applicator for applying an oil to the roller surface, may be any known binder resin for toners. Examples thereof may include: homopolymers of styrene and its derivatives, such as polystyrene, poly-p-chlorostyrene, and polyvinyltoluene; styrene copolymers, such as styrene-p-chlorostyrene copolymer, styrene-vinyltoluene copolymer, styrene-vinylnaphthalene copolymer, styrene-acrylate copolymer, styrene-methacrylate copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer-, and styrene-acrylonitrile-indene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinylbutyral, terpene resin, coumaroneindene resin and petroleum resin.

In a hot pressure roller fixing system using substantially no oil application, serious problems are provided by an offset phenomenon that a part of toner image on toner image-supporting member is transferred to a roller, and an intimate adhesion of a toner on the toner image-supporting member. As a toner fixable with a less heat energy is generally liable to cause blocking or caking in storage or in a developing apparatus, this should be also taken into consideration. With these phenomenon, the physical property of a binder resin in a toner is most concerned. According to our study, when the content of a magnetic material in a toner is decreased, the adhesion of the toner onto the toner image-supporting member mentioned above is improved, while the offset is more readily caused and also the blocking or caking are also more liable. Accordingly, when a hot roller fixing system using almost no oil application is adopted in the present invention, selection of a binder resin becomes more serious. A preferred binder resin may for example be a crosslinked styrene copolymer, or a crosslinked polyester. Examples of comonomers to form such a styrene copolymer may include one or more vinyl monomers selected from: monocarboxylic acid having a double bond and their substituted derivatives, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and their substituted derivatives, such as maleic acid, butyl maleate, methyl maleate, and dimethyl maleate; vinyl esters, such as vinyl chloride, vinyl acetate, and vinyl benzoate; ethylenic olefins, such as ethylene, propylene, and butylene; vinyl ketones, such as vinyl methyl ketone, and vinyl hexyl ketone; vinyl ethers, such as vinyl methyl ether, vinyl ethyl ether, and vinyl isobutyl ethers.

The binder resin for constituting the toner of the present invention may comprise a crosslinking agent. As the crosslinking agent, a compound having two or more polymerizable double bonds may principally be used. Examples thereof include: aromatic divinyl compounds, such as divinylbenzene, and divinylnaphthalene; carboxylic acid esters having two double bonds, such as ethylene glycol diacrylate, ethylene glycol dimethacrylate, and 1, 3-butanediol diacrylate; divinyl compounds such as divinyl ether, divinyl sulfide and divinyl sulfone; and compounds having three or more vinyl groups. These compounds may be used singly or in mixture. In view of the fixability and anti-offset characteristic of the toner, the crosslinking agent may preferably be used in an amount of 0.01–10 wt. %, preferably 0.05–5 wt. %, based on the weight of the binder resin.

For a pressure-fixing system, a known binder resin for pressure-fixable toner may be used. Examples thereof may include: polyethylene, polypropylene, polymethylene, polyurethane elastomer, ethylene-ethyl acrylate copolymer, ethylene-vinyl acetate copolymer, ionomer resin, styrene-butadiene copolymer, styrene-isoprene copolymer, linear saturated polyesters and paraffins.

In order to provide the magnetic toner with a negative chargeability, it is possible to add a negative charge controller, such as an organometal complex or chelate compound. More specifically, there may be used monoazo metal complexes, acetylacetone metal complexes, and metal complexes of aromatic hydroxycarboxylic acids and aromatic dicarboxylic acids. In addition, there may be raised aromatic hydroxycarboxylic acids, aromatic mono- and polycarboxylic acids, and their metal salts, anhydrides and esters: phenol derivatives, such as bisphenols.

In order to provide the magnetic toner with a positive chargeability, it is possible to add a charge controller, such as nigrosine and its modified products, quaternary ammonium salts, such as tributylbenzyl-ammonium-1 hydroxy-4-naphthosulfonic acid salt, and tetrabutylammonium tetrafluoroborate; diorganotin oxides, such as dibutyltin oxide, dioctyltin oxide, and dicyclohexyltin oxide; and diorganotin borates, such as dibutyltin borate, dioctyltin borate, and dicyclo-hexyltin borate.

As another type of positive charge controller, there may be used a homopolymer of a monomer having an amino group represents by the formula:

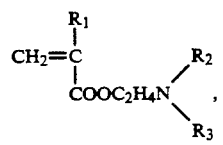

wherein $R_1$ represents H or $CH_3$; and $R_2$ and $R_3$ each represent a substituted or unsubstituted alkyl group (preferably $C_1$–$C_6$); or a copolymer of the monomer having an amine group with another polymerizable monomer such as styrene, acrylates, and methacrylates as described above. In this case, the positive charge controller also has a function of a binder.

It is preferred to externally add silica fine powder to the magnetic toner according to the present invention. A toner comprising a magnetic iron oxide containing silica element, a positive charge controller and silica fine powder is able to control the triboelectric chargeability to provide a stable charge better than a conventional toner.

The magnetic toner according to the present invention may be prepared as follows. First of all, a binder resin, magnetic iron oxide powder, a charge controller, etc., giving a magnetic toner may be preliminarily blended by a blender such as a ball mill. The resultant blend is kneaded by means of a melt kneading device such as a roll mill. After cooling? the kneaded product is coarsely crushed to a size of several millimeters or smaller by using a crusher such as a hammer mill, followed by fine pulverization by using, e.g., an ultrasonic jet pulverizer into fine particles on the order of 0.1–50 microns. The thus obtained fine particles may be classified to obtain a toner. In this instance, a toner having a prescribed particle size distribution may be obtained by controlling the crushing and pulverization to set a particle size distribution before the classification and controlling the classification depending on the specific gravity and the feed rate of the toner. Examples the classifier suitable for removing finer particles may include wind-force classifiers, such as Microplex 132 MP (trade name) available from Alpine Co., Acucut A-12 (trade name) available from Donaldson Co. and Micron Separator MS-1 available from Hosokawa Tekko K.K. Examples of the classifier suitable for removing coarser particles may include wind-force classifiers such a Microplex 400 MP (trade name) available from Alpine Co. and Micron Separator MS-1 available from Hosokawa Micron K.K. and a shifter classifier such as Blower Shifter available from Taikoh K.K.

An example of production of a toner through pulverization has been described above. In addition to the above, it is also possible to produce the magnetic toner according to the present invention also through various processes inclusive of suspension polymerization, or microencapsulation.

Into the magnetic toner according to the invention, it is also possible to incorporate a waxy substance, such as low-molecular weight polyethylene, low-molecular weight polypropylene, microcrystalline wax, carnauba wax, or sasol wax, in a proportion of 0.5–6 wt. % of the binder resin so as to improve the releasability at the time of hot roller fixation.

It is preferred to add silica fine powder to the magnetic toner according to the present invention so as to improve the charge stability, developing characteristic, fluidity or durability.

The silica fine powder used in the present invention may provide good results when it has a specific surface area of 30 $m^2/g$. as measured by the BET method using nitrogen absorption. It is preferred to use 0.01–8 wt. parts, particularly 0.1–5 wt. parts, of silica fine powder per 100 wt. parts of toner particles.

The silica fine powder used in the present invention may have been preferably treated with one or more of organic silicon compounds, such as silicon varnish, variously modified silicone varnish, silicone oil, variously modified silicone oil, silane coupling agents, and silane coupling agents having functional groups, as desired, for the purpose of providing hydrophobicity, controlling chargeability, etc.

Examples of other additives to the magnetic toner according to the present invention may include: lubricants, such as polytetrafluoroethylene, zinc stearate and polyvinylidene fluoride, among which polyvinylidene fluoride is preferred; abrasives, such as cerium oxide, silicon carbide, and strontium titanate, among which strontium titanate is preferred; fluidity-improving agents, such as titanium oxide and aluminum oxide with hydrophobic ones being preferred; anti-caking agent; conductivity-imparting agents, such as carbon black, zinc oxide, antimony oxide, and tin oxide; developing characteristic-improvers, such as white fine particles of a polarity opposite to that of the magnetic toner and black fine powder of a polarity opposite to that of the magnetic toner. These additives may be added in a relatively small amount, as desired.

The magnetic toner containing a specific magnetic iron oxide according to the present invention provides images having a high density with little change under varying environmental conditions. Further, even under low temperature-low humidity conditions, the magnetic toner retains an appropriate level of charge and high image densities without causing a lowering in image density due to charge-up.

Hereinbelow, the present invention will be described in more detail with reference to Examples, which however should not be understood to restrict the invention in any way. The "parts" used in describing compositional ratios are by weight.

First of all, Examples of production of magnetic iron oxide are set forth hereinbelow.

PRODUCTION EXAMPLE 1

53 kg of $FESO_4$ was dissolved in 50 liter of water and maintained at a temperature of 40° C. or higher while being warmed with steam, thereby to form a solution having an iron concentration of 2.4 mol/liter. The solution was subjected oxidation at about 70° C. by blowing air, as an oxygen-containing gas, thereinto.

The resultant slurry was subjected to filtration, washing with water and drying to obtain magnetic iron oxide. In order to control the content and distribution of FeO in the magnetic iron oxide, the oxidation was performed at 80° C. for 24 hours, and the drying was performed at 60° C. in an air atmosphere at a normal pressure for 72 hours as shown in Table 1 appearing hereinafter together with the conditions in other production examples. Physical properties of the magnetic iron oxide thus obtained are shown in Table 2 together with those of the other Examples.

FIG. 1 shows the change in ratio of dissolved FE(II) (ferrous iron)/dissolved iron element (total iron) versus the change in dissolved total iron percentage.

PRODUCTION EXAMPLES 2–8 AND COMPARATIVE PRODUCTION

Examples 1–6

The procedure of Example 1 was repeated except that the oxidation time and temperature, and the drying time, temperature, atmosphere and pressure were respectively changed as shown in Table 1, whereby the magnetic iron oxides having physical properties shown in Table 2 were respectively prepared.

The changes in dissolved FE(II) content (i.e., ratio of dissolved Fe(II)/dissolved total iron) versus the change in the dissolved total iron percentage for these Production Examples and Comparative Production Examples are shown in any one of FIGS. 1–4.

Figure 3:
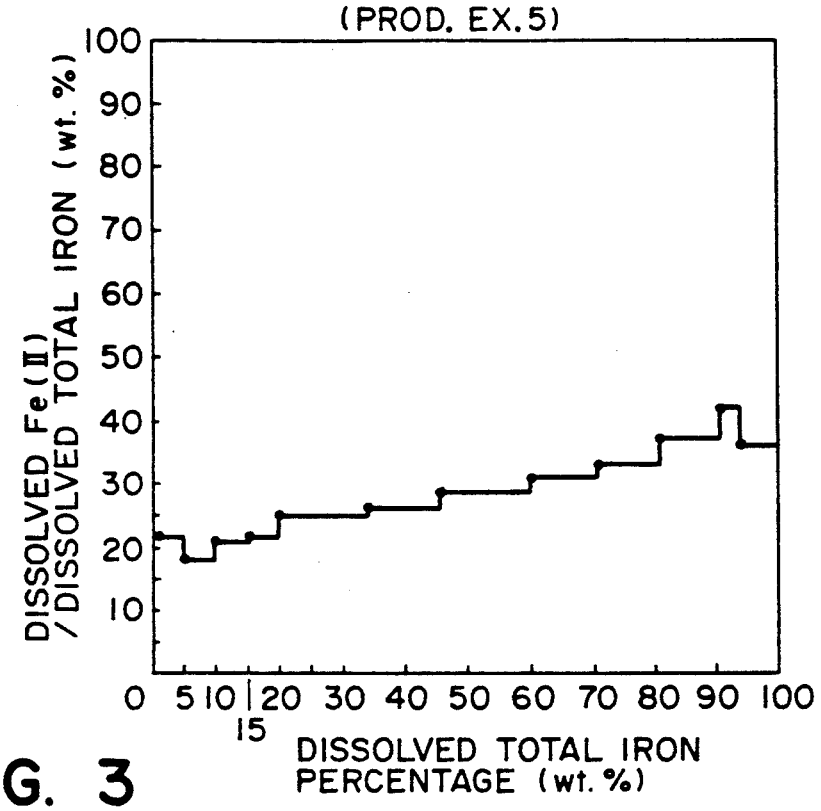
FIG. 3 is a graph showing a change in ratio of (dissolved Fe(II)/dissolved total iron) versus dissolved total iron percentage (wt. %) of magnetic iron oxide according to Production Example 5.
Figure 4:
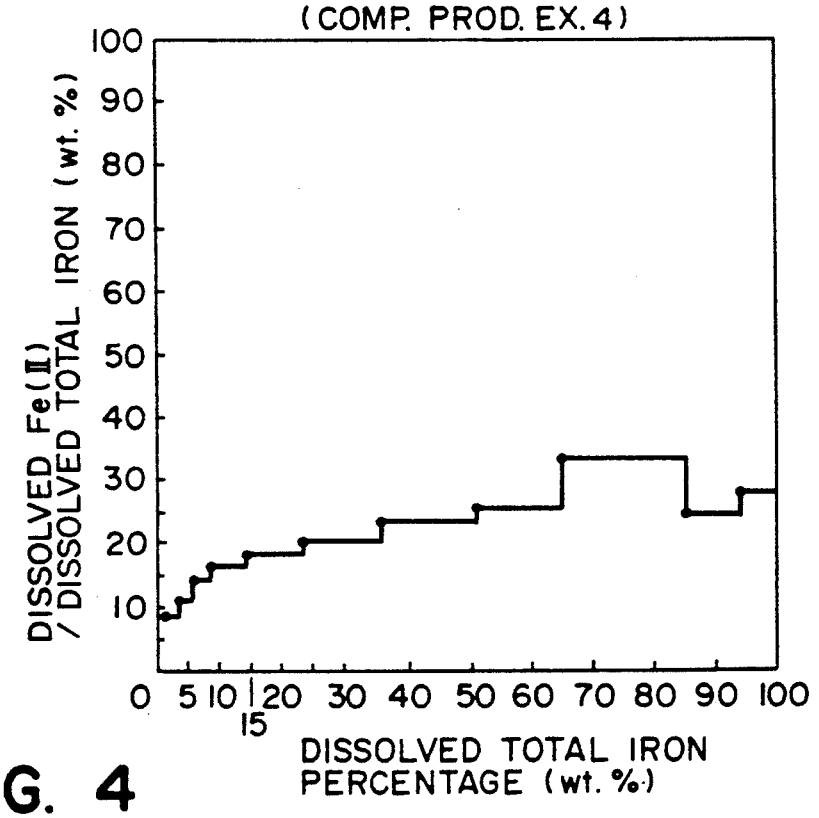
FIG. 4 is a graph showing a change in ratio of (dissolved Fe(II)/dissolved total iron) versus dissolved total iron percentage (wt. %) of magnetic iron oxide according to Comparative Production Example 4.

For reference, Table 3 lists raw experimental data taken at an interval of 10 min. for the magnetic iron oxide of Production Example 5 giving FIG. 3. For example, the dissolved FE(II) content at the dissolved total iron percentages of 2.0 wt. % and 5.1 wt. % can be calculated based on the values in Table 3 as follows:

$$\text{at 2.0 wt. \%: } (15.40/70.0) \times 100 = 22(\text{wt. \%})$$

$$\text{at 5.1 wt. \%: } [(34.93 - 15.40)/(178.5 - 70.0)] \times 100 = 18(\text{wt. \%})$$

TABLE 1

| Production Ex. No. | Oxidation conditions Temp. (°C.) | Oxidation conditions Time (hr) | Drying conditions 1st time Atmosphere | 1st time Temp. (°C.) | 1st time Time (hr) | 1st time Press. | 2nd time Atmosphere | 2nd time Temp. (°C.) | 2nd time Time (hr) | 2nd time Press. |
|---|---|---|---|---|---|---|---|---|---|---|
| Ex. | | | | | | | | | | |

TABLE 1-continued

| Production Ex. No. | Oxidation conditions Temp. (°C.) | Oxidation conditions Time (hr) | Drying conditions 1st time Atmosphere | 1st time Temp. (°C.) | 1st time Time (hr) | 1st time Press. | 2nd time Atmosphere | 2nd time Temp. (°C.) | 2nd time Time (hr) | 2nd time Press. |
|---|---|---|---|---|---|---|---|---|---|---|
| 1 | 80 | 24 | Air | 60 | 72 | Normal | — | — | — | — |
| 2 | 80 | 24 | Air | 50 | 24 | −5 mm Hg | — | — | — | — |
| 3 | 75 | 24 | Air | 70 | 10 | −40 mm Hg | — | — | — | — |
| 4 | 80 | 24 | Air | 130 | 15 min. | Normal | Air | 70 | 5 | Normal |
| 5 | 85 | 20 | $N_2$ | 130 | 6 | Normal | — | — | 6 | Normal |
| 6 | 80 | 20 | $N_2$ | 70 | 20 | Normal | — | — | 20 | Normal |
| 7 | 75 | 26 | $N_2$ | 150 | 5 | Normal | — | — | 5 | Normal |
| 8 | 80 | 25 | Ar | 75 | 18 | Normal | $H_2$ | 60 | 10 | Normal |
| Comp. Ex. | | | | | | | | | | |
| 1 | 50 | 48 | Air | 50 | 48 | Normal | $H_2$ | Normal | 12 | Normal |
| 2 | 70 | 18 | Air | 130 | 5 | Normal | — | — | — | — |
| 3 | 95 | 24 | Air | 50 | 24 | Normal | Air | 70 | 48 | Normal |
| 4 | 80 | 20 | Air | 130 | 6 | Normal | — | — | — | — |
| 5 | 80* | 20 | Air | 70 | 10 | Normal | Air | 100 | 10 | Normal |
| 6 | 80 | 25 | $N_2$ | 70 | 10 | Normal | Air | 130 | 3 | Normal |

*A mixture of air/$N_2$ (= 1/1) was blown in during oxidation.

TABLE 2

| Production Example No. | Physical properties: Dissolved Fe(II)/dissolved total iron (wt. %) Dissolved total iron percentage 5 ± 1% | 10 ± 1% | 15 ± 1% | FeO/Fe (wt. %) | $\bar{D}$* (μm) |
|---|---|---|---|---|---|
| Example | | | | | |
| 1 | 21.6 | 23.0 | 23.4 | 36.9 | 0.19 |
| 2 | 29.2 | 29.7 | 29.5 | 39.5 | 0.28 |
| 3 | 25.6 | 27.0 | 27.8 | 38.7 | 0.22 |
| 4 | 19.0 | 20.0 | 20.7 | 32.9 | 0.21 |
| 5 | 18.0 | 21.0 | 22.0 | 37.2 | 0.19 |
| 6 | 17.0 | 18.0 | 25.0 | 36.9 | 0.27 |
| 7 | 14.0 | 17.0 | 19.0 | 36.5 | 0.15 |
| 8 | 18.0 | 25.0 | 28.0 | 38.4 | 0.23 |
| Comp. Example | | | | | |
| 1 | 14.8 | 15.9 | 16.5 | 43.2 | 0.42 |
| 2 | 35.5 | 34.1 | 34.0 | 28.1 | 0.30 |
| 3 | 17.8 | 17.9 | 18.1 | 24.5 | 0.09 |
| 4 | 11.0 | 16.0 | 18.0 | 29.1 | 0.21 |
| 5 | 14.0 | 15.0 | 36.0 | 37.2 | 0.10 |
| 6 | 17.0 | 11.0 | 17.0 | 38.9 | 0.40 |

*Average particle size

TABLE 3

| Dissolution time (min.) | Dissolved total iron conc. (mg/l) | Dissolved total iron percentage (wt. %) | Dissolved Fe(II) conc. (mg/l) | Dissolved Fe(II) content (wt. %)* |
|---|---|---|---|---|
| 10 | 70.0 | 2.0 | 15.40 | 22 |
| 20 | 178.5 | 5.1 | 34.93 | 18 |
| 30 | 371.0 | 10.6 | 75.35 | 21 |
| 40 | 525.0 | 15.0 | 109.23 | 22 |
| 50 | 735.0 | 21.0 | 161.73 | 25 |
| 60 | 1207.5 | 34.5 | 284.58 | 26 |
| 70 | 1627.5 | 46.5 | 402.18 | 28 |
| 80 | 2110.5 | 60.3 | 55.19 | 31 |
| 90 | 2467.5 | 70.5 | 173.00 | 33 |
| 100 | 2803.5 | 80.1 | 300.68 | 38 |
| 110 | 3171 | 90.6 | 455.03 | 42 |
| 120 | 3290 | 94.0 | 497.87 | 36 |
| 130 | 3500 | 100 | — | — |
| 140 | 3500 | 100 | — | — |

*The percentage value for each 10 min. increment.

Now, Examples of toner production using the above magnetic iron oxides prepared in the above production examples are described.

EXAMPLE 1

| | |
|---|---|
| Styrene/n-butyl acrylate/divinylbenzene copolymer (copolymerization wt. ratio: 80/19.5/0.5, weight-average molecular weight (Mw): 30 × $10^4$) | 100 parts |
| Negative charge controller (monoazo chromium complex) | 2 parts |
| Low-molecular weight polypropylene | 3 parts |
| Magnetic iron oxide of Production Example 1 | 80 parts |

The above ingredients were sufficiently mixed by a blender and melt-kneaded at 150° C. by a roll mill. The kneaded product was cooled, coarsely crushed by a hammer mill, finely pulverized by a pulverizer using a jet air stream and classified by a wind-force classifier, to obtain magnetic black powder (magnetic toner) having a volume-average particle size of 8.2 microns.

4 parts of strontium titanate powder and 0.6 part of hydrophobic silica fine powder ("R812" available from Nihon Aerosil K.K.) were added to 100 parts of the above-obtained black powder and blended therewith by means of a Henschel mixer to obtain a magnetic toner.

The thus obtained magnetic toner was subjected to an image formation test by using a commercially available copying machine ("NP-8582", available from Canon K.K.). As a result, under the normal temperature/normal humidity conditions of 23.5° C./60 % RH, the resultant images showed a high density of 1.38, were free from ground fog and showed a high resolution. Further, a high image density of 1.35 was obtained under low temperature/low humidity conditions of 15° C./10 % RH, and a high image density of 1.31 was obtained under high temperature/high humidity conditions of 32.5° C./85 % RH. Thus, little change in image density was observed under various environmental conditions. Further, during a successive copying test for 50000 sheets, the resultant images showed a stable image density and were substantially free from ground fog or reversal fog.

The results of evaluation are summarized in Table 3 appearing hereinafter together with the results in other Examples and Comparative Examples.

EXAMPLES 2–4

Magnetic toners were prepared in the game manner as in Example 1 except that magnetic iron oxides of Production Examples 2–4, respectively, were used instead of the magnetic iron oxide of Production Example 1. The thus obtained magnetic toners were respectively subjected to the same image formation test as in Example 1. As a result, these toners all showed high densities with little change under various environmental conditions and stable performance under successive copying.

EXAMPLE 5

A magnetic toner was prepared in the same manner as in Example 1 except for using 4 parts of nigrosine instead of 2 parts of the negative charge controller and subjected to an image formation test by using a commercially available copying machine ("NP4835", available from Canon K.K.), whereby clear images having a high image density were obtained with little change under varying environmental conditions and stably even during successive copying.

COMPARATIVE EXAMPLE 1

A magnetic toner was prepared in the same manner as in Example 1 except for using the magnetic iron oxide of Comparative Production Example 1 instead of the magnetic iron oxide of Production Example 1. The magnetic toner thus obtained was subjected to the same image formation test as in Example 1.

Under the normal temperature/normal humidity conditions of 23.5° C./60 % RH, the resultant images showed an image density of 1.27 lower than in Example 1 and were accompanied with a slight degree of ground fog. Under the low temperature/low humidity conditions of 10° C./15 % RH, the resultant images were accompanied with noticeable fog and caused a lowering in image density from 1.30 at the initial stage to 1.15 after 30,000 sheets of successive copying. Under the high temperature/high humidity conditions of 32.5° C./85 %RH, the images showed a low image density of 1.02 even at the initial stage which was further lowered to 0.95 after 30,000 sheets of successive copying.

COMPARATIVE EXAMPLE 2

A magnetic toner was prepared in the same manner as in Example 1 except for using the magnetic iron oxide of Comparative Production Example 2 instead of the magnetic iron oxide of Production Example 1. The magnetic toner thus obtained was subjected to the same image formation test as in Example 1.

Under the normal temperature/normal humidity conditions, the resultant images showed a lower image density than in Example 1. Under the low temperature/low humidity conditions, the resultant images caused a lowering in image density from 1.15 at the initial stage to 1.09 after 30,000 sheets of successive copying and further to 1.02 in 50,000 sheets of copying. Under the high temperature/high humidity conditions, the images at the initial stage showed a image density of 1.22 but were accompanied with noticeable toner scattering, and the image density was lowered to 1.08 after 50,000 sheets of successive copying.

COMPARATIVE EXAMPLE 3

A magnetic toner was prepared in the same manner as in Example 1 except for using the magnetic iron oxide of Comparative Production Example 3 instead of the magnetic iron oxide of Production Example 1. The magnetic toner thus obtained was subjected to the same image formation test as in Example 1.

Under the normal temperature/normal humidity conditions, the resultant images substantially comparable with those in Example 1. However, under the low temperature/low humidity conditions, the images showed a slightly lower image density at the initial stage of 1.30 than in Example 1, which was then lowered to 1.28 after 30,000 sheets of successive copying and then to 1.20 after 50,000 sheets of successive copying. Under the high temperature/high humidity conditions, the image density was lowered from 1.28 at the initial stage to 1.24 after 30,000 sheets of copying and then to 1.21 after 50,000 sheets.

The results of image density evaluation in the above Examples and Comparative Examples are summarized in Table 4 below.

TABLE 4

| | Image Density* | | | | | | | | | | | |
|---|---|---|---|---|---|---|---|---|---|---|---|---|
| | Initial stage | | | After 10000 sheets | | | After 30000 sheets | | | After 50000 sheets | | |
| | NT/NH | LT/LH | HT/HH | NT/NH | LT/LH | HT/HH | NT/NH | LT/LH | HT/HH | HT/NH | LT/LH | HT/HH |
| Ex. | | | | | | | | | | | | |
| 1 | 1.38 | 1.35 | 1.31 | 1.37 | 1.35 | 1.32 | 1.37 | 1.34 | 1.33 | 1.36 | 1.35 | 1.30 |
| 2 | 1.38 | 1.36 | 1.29 | 1.35 | 1.34 | 1.30 | 1.35 | 1.33 | 1.31 | 1.36 | 1.32 | 1.28 |
| 3 | 1.36 | 1.30 | 1.30 | 1.35 | 1.31 | 1.28 | 1.34 | 1.33 | 1.29 | 1.33 | 1.34 | 1.28 |
| 4 | 1.35 | 1.31 | 1.27 | 1.33 | 1.32 | 1.30 | 1.33 | 1.34 | 1.31 | 1.32 | 1.31 | 1.31 |
| 5 | 1.35 | 1.33 | 1.31 | 1.33 | 1.31 | 1.29 | 1.34 | 1.30 | 1.30 | 1.35 | 1.33 | 1.29 |
| Comp. Ex. | | | | | | | | | | | | |
| 1 | 1.27 | 1.30 | 1.02 | 1.20 | 1.18 | 0.98 | 1.20 | 1.15 | 0.95 | 1.21 | 1.13 | 0.97 |
| 2 | 1.26 | 1.15 | 1.22 | 1.21 | 1.10 | 1.09 | 1.22 | 1.09 | 1.10 | 1.23 | 1.02 | 1.08 |
| 3 | 1.36 | 1.30 | 1.28 | 1.33 | 1.29 | 1.25 | 1.30 | 1.28 | 1.24 | 1.26 | 1.20 | 1.21 |

*Nt/NH: Normal temperature/normal humidity (= 23.5° C./60% RH)
LT/LH: Low temperature/low humidity (= 10° C./15% RH)
HT/HH: High temperature/high humidity (= 32.5° C./85% RH)

EXAMPLE 6

| | |
|---|---|
| Styrene/n-butyl acrylate/divinylbenzene copolymer (copolymerization wt. ratio: 79/20.5/0.5, weight-average molecular weight (Mw): 29 × $10^4$) | 100 parts |
| Negative charge controller (monoazo chromium complex) | 2 parts |
| Low-molecular weight polypropylene | 3 parts |
| Magnetic iron oxide of Production Example 5 | 80 parts |

The above ingredients were sufficiently mixed by a blender and melt-kneaded at 150° C. by a roll mill. The kneaded product was cooled, coarsely crushed by a hammer mill, finely pulverized by a pulverizer using a jet air stream and classified by a wind-force classifier, to obtain magnetic black powder (magnetic toner) having a volume-average particle size of 9.0 microns.

4 parts of strontium titanate powder and 0.6 part of hydrophobic silica fine powder ("R812" available from Nihon Aerosil K.K.) were added to 100 parts of the above-obtained black powder and blended therewith by means of a Henschel mixer to obtain a magnetic toner.

The thus obtained magnetic toner was subjected to an image formation test by using a commercially available copying machine ("NP-5060", available from Canon K.K.). As a result, under the normal temperature/normal humidity conditions of 23.5° C./60 % RH, the resultant images showed a high density of 1.40, were free from ground fog and showed a high resolution. Further, a high image density of 1.35 was obtained under low temperature/low humidity conditions of 15° C./10 % RH, and a high image density of 1.32 was obtained under high temperature/high humidity conditions of 32.5° C./85 % RH. Thus, little change in image density was observed under various environmental conditions. Further, during a successive copying test for 50000 sheets, the resultant images showed a stable image density and were substantially free from ground fog or reversal fog.

The results of evaluation are summarized in Table 5 appearing hereinafter together with the results in other Examples and Comparative Examples.

EXAMPLES 7-9

Magnetic toners were prepared in the same manner as in Example 6 except that magnetic iron oxides of Production Examples 6-8, respectively, were used instead of the magnetic iron oxide of Production Example 5. The thus obtained magnetic toners were respectively subjected to the same image formation test as in Example 6. As a result, these toners all showed high densities with little change under various environmental conditions and stable performance under successive copying.

EXAMPLE 10

A magnetic toner was prepared in the same manner as in Example 6 except for using 4 parts of nigrosine instead of 2 parts of the negative charge controller and subjected to an image formation test by using a commercially available copying machine ("NP3825", available from Canon K.K.), whereby clear images having a high image density were obtained with little change under varying environmental conditions and stably even during successive copying.

COMPARATIVE EXAMPLE 4

A magnetic toner was prepared in the same manner as in Example 6 except for using the magnetic iron oxide of Comparative Production Example 4 instead of the magnetic iron oxide of Production Example 5. The magnetic toner thus obtained was subjected to the same image formation test as in Example 6.

Under the normal temperature/normal humidity conditions of 23.5° C./60 % RH, the resultant images showed an image density of 1.28 lower than in Example 6 and were accompanied with a slight degree of ground fog. Under the low temperature/low humidity conditions of 10° C./15 %RH, the resultant images were accompanied with noticeable fog and caused a lowering in image density from 1.27 at the initial stage to 1.18 after 30,000 sheets of successive copying. Under the high temperature/high humidity conditions of 32.5° C./85 % RH, the images showed an image density of 1.29 at the initial stage which was lowered to 1.25 after 30,000 sheets of successive copying.

COMPARATIVE EXAMPLE 5

A magnetic toner was prepared in the same manner as in Example 6 except for using the magnetic iron oxide of Comparative Production Example 5 instead of the magnetic iron oxide of Production Example 5. The magnetic toner thus obtained was subjected to the same image formation test as in Example 6.

Under the normal temperature/normal humidity conditions, the resultant images showed a lower image density than in Example 6. Under the low temperature/low humidity conditions, the resultant images caused a lowering in image density from 1.24 at the initial stage to 1.10 after 30,000 sheets of successive copying. Under the high temperature/high humidity conditions, the images at the initial stage showed a image density of 1.26 but were accompanied with noticeable toner scattering, and the image density was lowered to 0.97 after 30,000 sheets of successive copying.

COMPARATIVE EXAMPLE 6

A magnetic toner was prepared in the same manner as in Example 6 except for using the magnetic iron oxide of Comparative Production Example 6 instead of the magnetic iron oxide of Production Example 1. The magnetic toner thus obtained was subjected to the same image formation test as in Example 6.

Under the normal temperature/normal humidity conditions, the resultant images showed an image density of 1.32, which was lowered to 1.23 after 30,000 sheets of copying. Under the low temperature/low humidity conditions, the images showed an image density at the initial stage of 1.30 which was then lowered to 1.17 after 30,000 sheets of successive copying. Under the high temperature/high humidity conditions, the image density was lowered from 1.28 at the initial stage to 1.21 after 30,000 sheets of copying.

The results of image density evaluation in the above Examples 6-8 and Comparative Examples 4-6 are summarized in Table 5 below.

TABLE 5

| | Image Density* | | | | | |
|---|---|---|---|---|---|---|
| | Initial Stage | | | After 30000 Sheets | | |
| | NT/NH | LT/LH | HT/HH | HT/HN | LT/LH | HT/HH |
| Example | | | | | | |
| 6 | 1.40 | 1.37 | 1.32 | 1.38 | 1.36 | 1.31 |
| 7 | 1.38 | 1.36 | 1.30 | 1.35 | 1.32 | 1.28 |
| 8 | 1.36 | 1.33 | 1.31 | 1.36 | 1.33 | 1.30 |
| 9 | 1.37 | 1.35 | 1.30 | 1.37 | 1.34 | 1.32 |
| 10 | 1.39 | 1.38 | 1.35 | 1.37 | 1.35 | 1.33 |
| Comp. Example | | | | | | |
| 4 | 1.28 | 1.27 | 1.29 | 1.24 | 1.18 | 1.25 |
| 5 | 1.24 | 1.20 | 1.26 | 1.10 | 1.02 | 1.13 |
| 6 | 1.32 | 1.30 | 1.28 | 1.23 | 1.17 | 1.21 |

*NT/NH: Normal temperature/normal humidity (= 23.5° C./60% RH)
LT/LH: Low temperature/low humidity (= 10° C./15% RH)
HT/HH: High temperature/high humidity (= 32.5° C./85% RH)

What is claimed is:

1. A magnetic toner comprising magnetic toner particles containing at least a binder resin and magnetic iron oxide particles, wherein the distribution of Fe (II) in a surface layer of said magnetic iron oxide particles satisfy the following conditions (a)-(c):

(a) a dissolved Fe (II) content in dissolved total iron of 14–33.3 wt. % at a dissolved total iron percentage in the range of 4–6 wt. %;

(b) a dissolved Fe (II) content in dissolved total iron of 17–33.3 wt. % at a dissolved total iron percentage in the range of 9–11 wt. %; and (c) a dissolved Fe (II) content in dissolved total iron of 18–33 wt. % at a dissolved total iron percentage in the range of 14–16 wt. % and said magnetic iron oxide particles have an FeO content based on total Fe of 30–40 wt. %.

2. The magnetic toner according to claim 1, wherein said magnetic iron oxide particles satisfy the following conditions (d)–(e):

(d) a dissolved Fe (II) content in dissolved total iron of 14–30 wt. % at a dissolved total iron percentage in the range of 4–6 wt. %, (e) a dissolved Fe (II) content in dissolved total iron of 17–32 wt. % at a dissolved total iron percentage in the range of 9–11 wt. %, (f) a dissolved Fe (II) content in dissolved total iron of 19–33 wt. % at a dissolved total iron percentage in the range of 14–16 wt. %.

3. The magnetic toner according to claim 2, wherein said magnetic iron oxide particles have an apparent bulk density of 0.1–1.2 g/cc.

4. The magnetic toner according to claim 2, wherein said magnetic iron oxide particles have an average particle size which is larger than 0.05 micron and smaller than 0.35 micron.

5. The magnetic toner according to claim 2, wherein said magnetic iron oxide particles have an average particle size which is larger than 0.10 micron and smaller than 0.28 micron.

6. The magnetic toner according to claim 2, wherein said binder resin comprises a styrene-type copolymer.

7. The magnetic toner according to claim 6, wherein said binder resin comprises a styrene-n-butyl acrylate-divinylbenzene copolymer.

8. The magnetic toner according to claim 2, wherein said magnetic toner particles contain 40–150 wt. parts of the magnetic iron oxide particles per 100 wt. parts of the binder resin.

9. The magnetic toner according to claim 2, wherein said magnetic toner particles contain 50–120 wt. parts of the magnetic iron oxide particles per 100 wt. parts of the binder resin.

10. The magnetic toner according to claim 2, wherein said binder resin contains a crosslinking agent.

11. The magnetic toner according to claim 2, wherein said magnetic toner particles contain a charge control agent.

12. The magnetic toner according to claim 2, wherein said magnetic toner particles contain a waxy substance in a proportion of 0.5–6 wt. % based on the binder resin.

13. The magnetic toner according to claim 2, which further comprises hydrophobic silica fine powder.

14. The magnetic toner according to claim 13, which contains 0.1–5 wt. parts of the hydrophobic silica fine powder per 100 wt. parts of the magnetic toner particles.

15. The magnetic toner according to claim 1, wherein said magnetic iron oxide particles having a dissolved Fe (II) content in total iron y (wt. %) satisfying the following conditions (g) and (h) at a dissolved total iron percentage x (wt. %) satisfying $0<x\leqq 33.3$;

(g) $y\leqq 33.3$, and (h) $y\geqq 0.26x+16.0$.

16. The magnetic toner according to claim 15, wherein said magnetic iron oxide particles have an apparent bulk density of 0.1–1.2 g/cc.

17. The magnetic toner according to claim 15, wherein said magnetic iron oxide particles have an average particle size which is larger than 0.05 micron and smaller than 0.35 micron.

18. The magnetic toner according to claim 15, wherein said magnetic iron oxide particles have an average particle size which is larger than 0.10 micron and smaller than 0.28 micron.

19. The magnetic toner according to claim 15, wherein said binder resin comprises a styrene-type copolymer.

20. The magnetic toner according to claim 19, wherein said binder resin comprises a styrene-n-butyl acrylate-divinylbenzene copolymer.

21. The magnetic toner according to claim 15, wherein said magnetic toner particles contain 40–150 wt. parts of the magnetic iron oxide particles per 100 wt. parts of the binder resin.

22. The magnetic toner according to claim 15, wherein said magnetic toner particles contain 50–120 wt. parts of the magnetic iron oxide particles per 100 wt. parts of the binder resin.

23. The magnetic toner according to claim 15, wherein said binder resin contains a crosslinking agent.

24. The magnetic toner according to claim 15, wherein said magnetic toner particles contain a charge control agent.

25. The magnetic toner according to claim 15, wherein said magnetic toner particles contain a waxy substance in a proportion of 0.5–6 wt. % based on the binder resin.

26. The magnetic toner according to claim 15, which further comprises hydrophobic silica fine powder.

27. The magnetic toner according to claim 26, which contains 0.01–8 wt. parts of the hydrophobic silica fine powder per 100 wt. parts of the magnetic toner particles.

28. The magnetic toner according to claim 1, wherein said magnetic iron oxide particles have a dissolved Fe (II) content in total iron y (wt. %) satisfying the following conditions (g) and (h) at a dissolved total iron percentage x (wt. %) satisfying $4\leqq x\leqq 16$:

(g) $y\leqq 33.3$, and (h) $y\geqq 0.26x+16.0$.

29. The magnetic toner according to claim 28, wherein said magnetic iron oxide particles have an apparent bulk density of 0.1–1.2 g/cc.

30. The magnetic toner according to claim 28, wherein said magnetic iron oxide particles have an average particle size which is larger than 0.05 micron and smaller than 0.35 micron.

31. The magnetic toner according to claim 28, wherein said magnetic iron oxide particles have an average particle size which is larger than 0.10 micron and smaller than 0.28 micron.

32. The magnetic toner according to claim 28, wherein said binder resin comprises a styrene-type copolymer.

33. The magnetic toner according to claim 32, wherein said binder resin comprises a styrene-n-butyl acrylate-divinylbenzene copolymer.

34. The magnetic toner according to claim 28, wherein said magnetic toner particles contain 40–150 wt. parts of the magnetic iron oxide particles per 100 wt. parts of the binder resin.

35. The magnetic toner according to claim 28, wherein said magnetic toner particles contain 50–120 wt. parts of the magnetic iron oxide particles per 100 wt. parts of the binder resin.

36. The magnetic toner according to claim 28, wherein said binder resin comprises a crosslinking agent.

37. The magnetic toner according to claim 28, wherein said magnetic toner particles contain a charge control agent.

38. The magnetic toner according to claim 28, wherein said magnetic toner particles contain a waxy substance in a proportion of 0.5–6 wt. % based on the binder resin.

39. The magnetic toner according to claim 28, which further comprises hydrophobic silica fine powder.

40. The magnetic toner according to claim 39, which contains 0.01–8 wt. parts of the hydrophobic silica fine powder per 100 wt. parts of the magnetic toner particles.

41. The magnetic toner according to claim 1, wherein said magnetic iron oxide particles have an apparent bulk density of 0.1–1.2 g/cc.

42. The magnetic toner according to claim 1, wherein said magnetic iron oxide particles have an average particle size which is larger than 0.05 micron and smaller than 0.35 micron.

43. The magnetic toner according to claim 1, wherein said magnetic iron oxide particles have an average particle size which is larger than 0.10 micron and smaller than 0.28 micron.

44. The magnetic toner according to claim 1, wherein said binder resin comprises a styrene-type copolymer.

45. The magnetic toner according to claim 44, wherein said binder resin comprises a styrene-n-butyl acrylate-divinylbenzene copolymer.

46. The magnetic toner according to claim 1, wherein said magnetic toner particles contain 40–150 wt. parts of the magnetic iron oxide particles per 100 wt. parts of the binder resin.

47. The magnetic toner according to claim 1, wherein said magnetic toner particles contain 50–120 wt. parts of the magnetic iron oxide particles per 100 wt. parts of the binder resin.

48. The magnetic toner according to claim 1, wherein said binder resin contains a crosslinking agent.

49. The magnetic toner according to claim 1, wherein said magnetic toner particles contain a charge control agent.

50. The magnetic toner according to claim 1, wherein said magnetic toner particles contain a waxy substance in a proportion of 0.5–6 wt. % based on the binder resin.

51. The magnetic toner according to claim 1, which further comprises hydrophobic silica fine powder.

52. The magnetic toner according to claim 51, which contains 0.1–5 wt. parts of the hydrophobic silica fine powder per 100 wt. parts of the magnetic toner particles.

* * * * *

UNITED STATES PATENT AND TRADEMARK OFFICE

CERTIFICATE OF CORRECTION

PATENT NO. : 5,296,326

DATED : March 22, 1994

INVENTOR(S) : MASAAKI TAYA, ET AL.

It is certified that error appears in the above-identified patent and that said Letters Patent is hereby corrected as shown below:

ON TITLE PAGE

In [57] Abstract, "Feo" should read --FeO--.

COLUMN 1

Line 68, "because" should read --because of--.

COLUMN 2

Line 10, "brought to" should read --brought very close to--.

COLUMN 3

Line 40, "FE(II)" should read --Fe(II)--.
Line 42, "5±1 wt." should read --5±1 wt. %,--
Line 43, "FE(II)" should read --Fe(II)--.
Line 46, "FE(II)" should read --Fe(II)--.

COLUMN 4

Line 18, "has" should read --have--.
Line 33, "has" should read --is--.
Line 34, "JA-A 53-35697)." should read --JP-A 53-35697).--.
Line 55, "FE(II)" should read --Fe(II)--.
Line 56, "rather the" should read --rather than--.
Line 62, "FE(II)" should read --Fe(II)--.
Line 66, "FE(II)" should read --Fe(II)--.

UNITED STATES PATENT AND TRADEMARK OFFICE

CERTIFICATE OF CORRECTION

PATENT NO. : 5,296,326

DATED : March 22, 1994

INVENTOR(S) : MASAAKI TAYA, ET AL.

It is certified that error appears in the above-identified patent and that said Letters Patent is hereby corrected as shown below:

COLUMN 5

Line 5, "FE(II)" should read --Fe(II)--.
Line 9, "FE(II)" should read --Fe(II)--.
Line 11, "5±1 wt." should read --5±1 wt. %.--.
Line 12, "FE(II)" should read --Fe(II)--.
Line 14, "10±1 wt." should read --10±1 wt. %.--.
Line 15, "FE(II)" should read --Fe(II)--.
Line 17, "15±1 wt." should read --15±1 wt. %.--.
Line 20, "Fe(II)/content/dissolved" should read --FE(II) content/dissolved--.
Line 23, "FE(II)" should read --Fe(II)--.
Line 25, "5±1 wt." should read --5±1 wt. %.--.
Line 26, "FE(II)" should read --Fe(II)--.
Line 28, "10±1 wt." should read --10±1 wt. %.--.
Line 29, "FE(II)" should read --Fe(II)--.
Line 31, "15±1 wt." should read --15±1 wt. %.--.
Line 35, "to.," should read --to--.
Line 47, "FE(II)" should read --Fe(II)--.
Line 50, "FE(II)" should read --Fe(II)--.
Line 56, "30-40 wt." should read --30-40 wt. %.--.
Line 58, "FE(II)" should read --Fe(II)--.

COLUMN 6

Line 17, "oxide" should read --oxide particles--.
Line 40, "FE(II)" should read --Fe(II)--.
Line 43, "3 liter" should read --3 liters--.
Line 68, "(Concentration" should read --(concentration--.

UNITED STATES PATENT AND TRADEMARK OFFICE

CERTIFICATE OF CORRECTION

PATENT NO. : 5,296,326

DATED : March 22, 1994

INVENTOR(S) : MASAAKI TAYA, ET AL.

It is certified that error appears in the above-identified patent and that said Letters Patent is hereby corrected as shown below:

COLUMN 7

Line 3, "FE(II)" should read --Fe(II)--.
Line 9, "FE(II)" should read --Fe(II)--.
Line 10, "FE(II)" should read --Fe(II)--.
Line 12, "volume (ml))" should read --volume (ml)]--.
Line 13, "FE(II)" should read --Fe(II)--.
Line 23, "FE(II)" should read --Fe(II)--.
Line 26, "FE(II)" should read --Fe(II)-- and "$(Fe(II)_{10}Fe(II)_5]/-$" should read --$[Fe(II)_{10}-Fe(II)_5]/-$ --.
Line 27, "$[TI_{10}-TI_5)$" should read --$[TI_{10}-TI_5]$--.
Line 28, "FE(II)" should read --Fe(II)--.
Line 36, "FE(II)" should read --Fe(II)--.
Line 53, "1/10 x" should read --1/10×--.

COLUMN 8

Line 15, "fi. lm" should read --film--.
Line 29, "$(FESO_4)$" should read --$(FeSO_4)$--.
Line 30, "NAOH" should read --NaOH--.
Line 32, "NAOH" should read --NaOH--.
Line 46, "to-reduce" should read --to reduce-- and "FE(II)" should read --Fe(II)--.

COLUMN 9

Line 4, "copolymer-," should read --copolymer,--.
Line 11, "coumaroneindene" should read --coumarone-indene--.

--

UNITED STATES PATENT AND TRADEMARK OFFICE

CERTIFICATE OF CORRECTION

PATENT NO. : 5,296,326

DATED : March 22, 1994

INVENTOR(S) : MASAAKI TAYA, ET AL.

It is certified that error appears in the above-identified patent and that said Letters Patent is hereby corrected as shown below:

COLUMN 10

Line 13, "raised" should read --used--.
Line 28, "represents" should read --represented--.
Line 57, "cooling?" should read --cooling,--.
Line 68, "Examples" should read --Examples of--.

COLUMN 11

Line 7, "a" should read --as--.

COLUMN 12

Line 15, "$FESO_4$" should read --$FeSO_4$--.
Line 19, "subjected" should read --subjected to--.
Line 32, "FE(II)" should read --Fe(II)--.
Line 38, "Examples 1-6" should read --EXAMPLES 1-6--.
Line 45, "FE(II)" should read --Fe(II)--.
Line 52, "giving" should read --given in--.
Line 53, "FE(II)" should read --Fe(II)--.

COLUMN 14

TABLE 1-continued,

| | | |
|---|---|---|
| " 5 | should read -- | 5 |
| 6 | | – |
| 20 | | – |
| 5 | | – |
| 10 " | | 10 --. |

Line 60, "Table 3" should read --Table 4--.

UNITED STATES PATENT AND TRADEMARK OFFICE

CERTIFICATE OF CORRECTION

PATENT NO. : 5,296,326

DATED : March 22, 1994

INVENTOR(S) : MASAAKI TAYA, ET AL.

It is certified that error appears in the above-identified patent and that said Letters Patent is hereby corrected as shown below:

COLUMN 15

TABLE 4, "*Nt/NH:" should read --*NT/NH:--.

COLUMN 16

Line 3, "a" should read --an--.
Line 16, "images" should read --images were--.
TABLE 4, Under "After 50000 sheets", "HT/NH" should read --NT/NH--.

COLUMN 18

Line 41, "Examples 6-8" should read --Examples 6-10--.
TABLE 5, Under "After 30000 Sheets", "HT/HN" should read --NT/NH--.
Line 68, "isfy" should read --isfies--.

COLUMN 19

Line 14, "conditions (d)-(e):" should read --conditions (d)-(f):--.
Line 20, "9-11 wt. %," should read --9-11 wt. %, and--.
Line 66, "$0<x\leq 33.3$;" should read --$0<x\leq 33.3$:--.

--

UNITED STATES PATENT AND TRADEMARK OFFICE

CERTIFICATE OF CORRECTION

PATENT NO. : 5,296,326

DATED : March 22, 1994

INVENTOR(S) : MASAAKI TAYA, ET AL.

It is certified that error appears in the above-identified patent and that said Letters Patent is hereby corrected as shown below:

COLUMN 21

Line 13, "comprises" should read --contains--.

Signed and Sealed this

First Day of November, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,296,326

DATED : March 22, 1994

INVENTOR(S) : MASAAKI TAYA, ET AL.

It is certified that error appears in the above-identified patent and that said Letters Patent is hereby corrected as shown below:

COLUMN 19

Line 8, "-33 wt.%" should read -- -33.3 wt.%--.

Signed and Sealed this

Twenty-eight Day of February, 1995

*Attest:*

BRUCE LEHMAN

*Attesting Officer*

*Commissioner of Patents and Trademarks*